United States Patent [19]

Halliday

[11] 4,392,019

[45] Jul. 5, 1983

[54] SURROUND SOUND SYSTEM

[75] Inventor: Jonathan Halliday, Winchester, England

[73] Assignee: Independent Broadcasting Authority, London, England

[21] Appl. No.: 218,081

[22] Filed: Dec. 19, 1980

[51] Int. Cl.[3] ..... H04S 3/00

[52] U.S. Cl. ..... 179/1 GQ; 179/1 GD

[58] Field of Search ..... 179/1 GD, 1 GH, 1 GM, 179/1 GQ; 369/89

[56] References Cited

U.S. PATENT DOCUMENTS

| | | | |
|---|---|---|---|
| 3,679,832 | 7/1972 | Halpern | 179/1 GD |
| 3,824,342 | 7/1974 | Christensen et al. | 179/1 GQ |
| 4,095,049 | 6/1978 | Gerzon | 179/1 GQ |

*Primary Examiner*—A. D. Pellinen

*Attorney, Agent, or Firm*—Laubscher, Philpitt & Laubscher

[57] ABSTRACT

A system for surround sound utilizes three audio channels two of which are either in phase of 180° out of phase for all angles of elevation and azimuth of the incident sound and which can be decoded to give good quality stereo reception. The third channel contains the signal indicative of the "front-back" information and this signal is chosen to yield the best quality of surround sound reception consistent with minimum interference to the quality of mono and stereo reception for a given type or range of program material. Preferably, the third channel is phase shifted by 90° with respect to the phase of the other two channels. The three audio channels can be derived directly from three directional microphones or can be derived from the Ambisonics 'B' format in which case an encoding matrix of the following form is used:

$$\begin{bmatrix} \Sigma \\ \Delta \\ T \end{bmatrix} = \begin{bmatrix} 0.9 & 0.1092 & 0 \\ 0 & 0 & 0.6897 \\ -0.3954j & 0.3954j & 0 \end{bmatrix} \begin{bmatrix} W \\ X \\ Y \end{bmatrix}$$

where Σ, Δ and T are the signals in the three audio channels and W, X and Y are the input signals to the encoding matrix.

10 Claims, 6 Drawing Figures

SURROUND SOUND SYSTEM

BACKGROUND OF THE INVENTION

The present invention relates to sound reproduction and more particularly to a system for producing surround-sound.

While the present invention is applicable to recording and playback as well as to transmission and distribution the remainder of the specification will be directed to transmission and reception of a sound broadcast and decoders which such reception may share in common with such playback.

BRIEF DESCRIPTION OF THE PRIOR ART

For several years surround-sound systems have been investigated. All these systems, for broadcasting or recording on a recording medium such as a tape or disc, provide additional encoded information that is intended to enable the listener, if he wishes, to locate the relative positions of the instruments, voices and sounds at the time of the transmission or recording and so obtain, more completely than with conventional monophonic or stereophonic systems, an illusion of hearing the sounds in their original directions and/or in apparent directions chosen by the producer.

The invention takes as a basis the Ambisonic 'B' format which provides four basic signals, namely:

W—an omnidirectional signal;

X—a signal which together with W is indicative of the front-back position;

Y—a signal which together with W is indicative of the side-to-side position;

Z—a signal which together with W is indicative of height.

From these four signals it has been previously proposed to produce by linear mixing three signals, namely:

Σ—a sum signal equivalent to mono;

Δ—a difference signal which when taken with the Σ signal gives stereo and may also be decoded to give horizontal surround-sound of limited quality;

T—a third signal which with the other two signals gives horizontal surround-sound of good quality.

Experimental broadcast transmissions have been made during 1978 using such a system. In systems of that kind it was necessary to make a compromise, namely a diminution in the quality of the sound received by a listener having only stereo equipment. This diminution is due to the presence of phase differences necessarily introduced between the Σ and Δ signals (and consequently between the received stereo 'left' and 'right' signals) in order to make surround-sound decoding possible from these two signals alone.

It is an object of the present invention to provide an improved surround-sound system based on the work of NRDC/Ambisonics.

SUMMARY OF THE INVENTION

The present invention provides a system for transmission and reception of horizontal surround-sound by frequency modulation of a carrier, wherein the modulating signal contains a monophonic audio signal (here termed Σ), a subcarrier modulated by an audio signal equivalent to the stereo difference signal (here termed Δ) of a stereophonic broadcast, a pilot tone at half the subcarrier frequency, and in addition a second subcarrier in quadrature with the first and modulated by a third audio signal (here termed T), the signals Σ, Δ and T being defined in terms of the actual or intended direction of a sound to be reproduced, wherein the signals Σ and Δ are generated by an encoding means and are either in phase or 180° out of phase for all angles of elevation and azimuth of the incident sound whereby, in use, the best compatible signal can be chosen for a given type or range of programme material when received by monophonic and stereophonic receivers; and wherein the signal T is generated by the encoding means and may, in use, be chosen, having regard to the imperfections of real receivers, to yield the best quality of surround-sound reception consistent with minimum interference to the quality of mono and stereo reception for a given type or range of programme material. It is understood that all three audio signals are pre-emphasised according to the standard locally in force for stereo transmissions.

Phase shifts may be introduced between the T signal and the Σ and Δ signals.

This new proposal differs from the earlier proposal described above in that surround-sound decoding is not possible using the Σ and Δ signal alone; however, since phase differences are not present between these two signals, no compromise is made with the quality of stereo reception. The new proposal has the advantage that it is capable of being used with existing mono and stereo receivers to provide an acceptable quality of reception.

The transformation from 'B' format to our 3-channel transmission format may be achieved by an encoding matrix such as the one set out below:

$$\begin{bmatrix} \Sigma \\ \Delta \\ T \end{bmatrix} = \begin{bmatrix} 0.9 & 0.1092 & 0 \\ 0 & 0 & 0.6897 \\ -0.3954j & 0.3954j & 0 \end{bmatrix} \begin{bmatrix} W \\ X \\ Y \end{bmatrix}$$

After reception of the signal the reverse transformation is performed using a decoding matrix, which is the inverse of the encoding matrix, to yield signals W', X', Y' equivalent to the original B-format signals. These are then in turn decoded to yield loudspeaker drive signals using known Ambisonic techniques.

This system is not a universal system and exact results cannot be achieved by transmission or distribution systems and/or decoders using less than 3 full bandwidth audio channels or their multiplex or digital equivalent.

Details of how the 'B' format signals are produced have not been included since it is considered that this is well known to those skilled in the art.

BRIEF DESCRIPTION OF THE FIGURES

In order that the present invention be more readily understood, embodiments thereof will now be described by way of example with reference to the accompanying drawings, in which.

DETAILED DESCRIPTION

Figure 1:
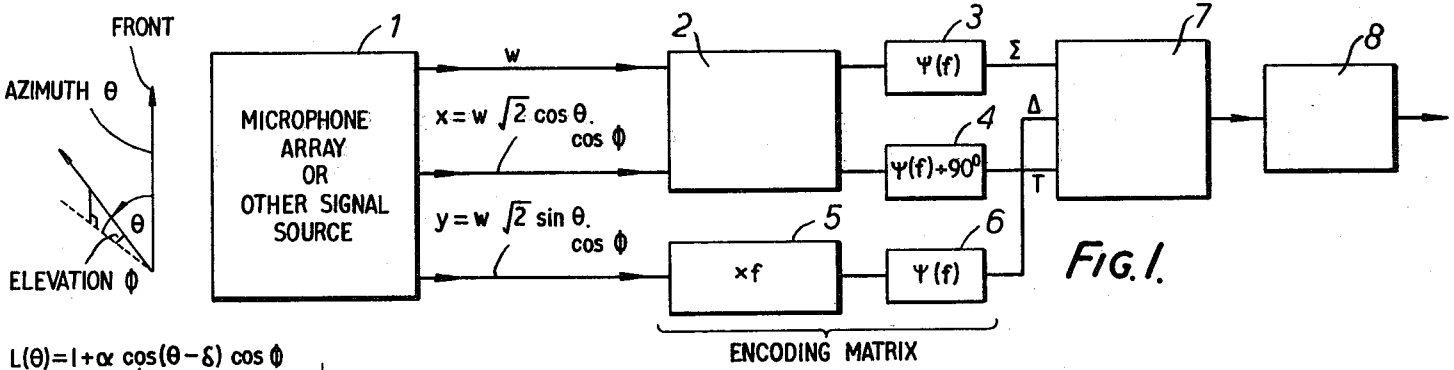
FIG. 1 is a block diagram representation of a transmitter of one embodiment of the present invention.

The following embodiment provides a system for transmitting and receiving 3 channels Σ, Δ, T which are derivatives of the channels W, X and Y of Ambisonic technology. Primarily the system is designed for optimum results via FM radio, but in certain respects it is also applicable to other means of dissemination, such as 3-channel analogue tape, or digital recordings with at least 3 audio channels. The problem is to encode (or mix) the 3 channels in such a way that those listening in stereo or mono to the same broadcast will hear good stereo or mono sound respectively. This is done by transmitting 3 channels (known as Σ, Δ and T) which are related to the original 3 channels by a matrix known as the encoding matrix; Σ, Δ and T are multiplexed together and transmitted according to a specification which is essentially the Zenith-GE pilot-tone system with an additional term for the T channel. The Σ signal is that which is heard by a mono listener. The Σ and Δ signals together yield the two channels heard in stereo reception according to the formulae:

$$L=k(\Sigma+\Delta),$$

$$R=k(\Sigma-\Delta)$$

(where k is arbitrary). The Σ, Δ and T signals together are used only by those listening in surround-sound.

It has previously been proposed (by NRDC/Ambisonics) to transmit signals Σ, Δ and T related to W, X and Y by a specification (known as System UHJ) having the properties that Σ yields a good compatible mono signal, Σ and Δ together yield stereo of moderate compatibility and are also capable of being decoded (into modified signals W', X', Y') to yield horizontal surround-sound of limited quality, and Σ, Δ and T together can be decoded to yield horizontal surround-sound of good quality. The advantage of such a system is that good surround-sound may be obtained even if T is received within a reduced audio bandwidth, which improves the signal-to-noise ratio in surround-sound reception; but the major disadvantage is that the quality of stereo reception is impaired by the necessary presence of phase shifts between the two audio channels, which for some types of programme material are unacceptable to many listeners.

According to the present embodiment signals Σ, Δ and T are transmitted, related to W, X and Y by a new matrix such that Σ yields good compatible mono, Σ and Δ together yield good compatible stereo, and Σ, Δ and T together can be decoded to yield good horizontal surround-sound. T, like Σ and Δ, needs to be received with the full (normally 15 kHz) audio bandwidth, so that the signal-to-noise ratio in surround-sound reception is somewhat worse than in the former proposal. However, the present proposal has the decisive advantage of better stereo compatibility. This is so because there are no audio phase shifts between Σ and Δ. Systems of this kind are of a fundamentally different class from systems of the former kind because there is no attempt to convey front/back information in the stereo channels. Without this technical constraint it is possible to choose the encoding matrix so as to produce the most compatible stereo (and mono) signals. Unfortunately, the optimum mix varies widely between different types of source material, in particular between presentations where the only direct (as opposed to reflected or reverberant) sound sources are placed in front of the listener and those where direct sound sources are placed all round. Hence if one encoding matrix is chosen to cover all types of material its stereo compatibility must be a compromise. The arrangement to be described incorporates such a compromise. It is this choosing of the best Σ and Δ signals which is equally applicable to other media such as 3-channel analogue tape or digital recordings.

The choice of third channel is also a compromise which depends on the type of programme material and on the choice of stereo channels. The present embodiment incorporates such a choice, which has been made bearing in mind the properties of multiplex FM transmission and reception. This specific choice is, therefore, *not* equally applicable to other media. This choice for multiplex FM transmission is made with the object of giving best signal/noise ratio in surround-sound reception consistent with minimum loss of coverage area in stereo and mono reception and minimum loss of quality due to the imperfections of existing receivers.

It will be noted that the signals, W, X, Y from which Σ, Δ and T are derived are by definition signals which indicate the intended location of the reproduced sound in the horizontal plane. Nothing in this, however, precludes the use of height information in generating these signals W X Y by previous processing according to Ambisonic principles, for example by tilting the response pattern of a microphone array. Neither does the present embodiment preclude the additional transmission of height information by the use of a fourth or further channels added to the multiplexed signal.

Referring now to the drawings FIG. 1 shows one way in which a transmitter for surround-sound according to the present proposal may be constructed. Block 1 represents an array of a plurality of microphones or some other signal source which can be arranged to produce three outputs W, X and Y defined according to Ambisonic technology where W is an omnidirectional signal, $X=W\sqrt{2}\cdot\cos\theta\cos\phi$, and $Y=W\sqrt{2}\cdot\sin\theta\cos\phi$. The angle $\theta$ is the azimuth of the sound direction, measured anticlockwise from centre-front, and $\phi$ is its angle of elevation. These three signals are fed to an encoding circuit where they are transformed into signals Σ, Δ and T.

When the requirements are taken into account that there are no phase shifts between the stereo channels for any sound direction, that the transmitted signals Σ, Δ and T contain no component representative of height (i.e. the Z signal is not used), and that sounds symmetrically placed to left and right in surround-sound are reproduced with a similar left-right symmetry in stereo reception, the possible choices of encoding matrix are restricted. When the requirements mentioned above for choice of the third channel for FM multiplex transmission are also taken into account, it is found that the best general form of the encoding matrix is:

$$\begin{bmatrix}\Sigma\\ \Delta\\ T\end{bmatrix}=\begin{bmatrix}a & b & 0\\ 0 & 0 & f\\ gj & hj & o\end{bmatrix}\begin{bmatrix}W\\ X\\ Y\end{bmatrix}$$

where a, b, f, g and h are real and j represents a broadband phase advance of B 90°.

In FIG. 1 the encoding circuit is shown as containing a linear mixer and amplifier circuit 2 to which the W and X signals are applied and from which signals aW+bX and gW+hX are generated. The signal aW+bX is fed through an all-pass filter network 3 to produce the Σ signal while the gW+hX signal is passed through another all-pass filter network 4 which relative to network 3 introduces a 90° phase advance to produce the T signal. The Y signal is fed to a multiplying circuit 5 of co-efficient f and then through an all-pass flter network 6 identical to network 3 to produce the Δ signal. It should be understood that the equations implied by the encoding matrix permit the introduction of a frequency-dependent phase shift x(w) common to all the networks 3, 4, 6, and indeed any filters or other circuitry in the transmission/reception chain may also introduce arbitrary phase shifts common to all 3 channels, provided that the amplitude and phase relationships between the 3 channels remain as defined by the encoding matrix. The Σ, Δ and T signals at the output of the encoding circuit are fed to a multiplexing circuit 7 and thence to an FM transmitter section 8. The transmitted multiplex signal is $\Sigma+\Delta \sin 2\omega_o t+T \cos 2\omega_o t+0.1 \sin \omega_o t$ ($\omega=2\pi\times 19$ kHz).

It has been found that the preferred coefficients are as follows:

| | |
|---|---|
| a = 0.9 | g = −0.3954 |
| b = 0.1092 | h = 0.3954 |
| f = 0.6897 | |

Figure 6:
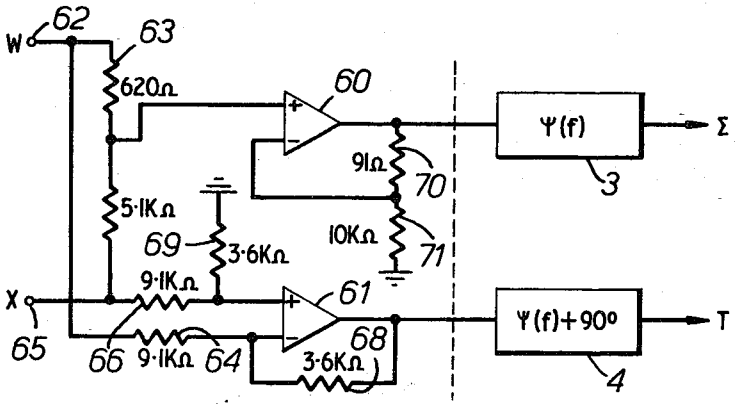
FIG. 6 shows a circuit diagram of a part of the circuit shown in FIG. 1.

FIG. 6 shows the circuit diagram for the linear mixer and amplifier circuit 2 of FIG. 1. The circuit is based on two operational amplifiers 60 and 61. The W signal is fed via an input terminal 62 and a resistor 63 to the non-inverting input of the amplifier 60 and via a resistor 64 to the inverting input of the amplifier 61. The X signal is fed via an input terminal 65 and a resistor 66 to the non-inverting input of the amplifier 61 which is earthed via a resistor 69 and via a resistor 67 to the non-inverting input of the amplifier 60.

The output of the amplifier 61 is fed back via a feedback resistor 68 to the inverting input of the amplifier 61 and is also fed to the network 4. The output of the amplifier 60 is fed to the network 3 and is also connected to two resistors 70 and 71 connected in series between the output and earth. The junction between the resistors 70 and 71 is connected to the inverting input of the amplifier 60.

With the resistors having the standard preferred values as given in FIG. 6 the outputs from the networks 3 and 4 will be a good approximation to the encoding matrix specified above.

Figure 2:
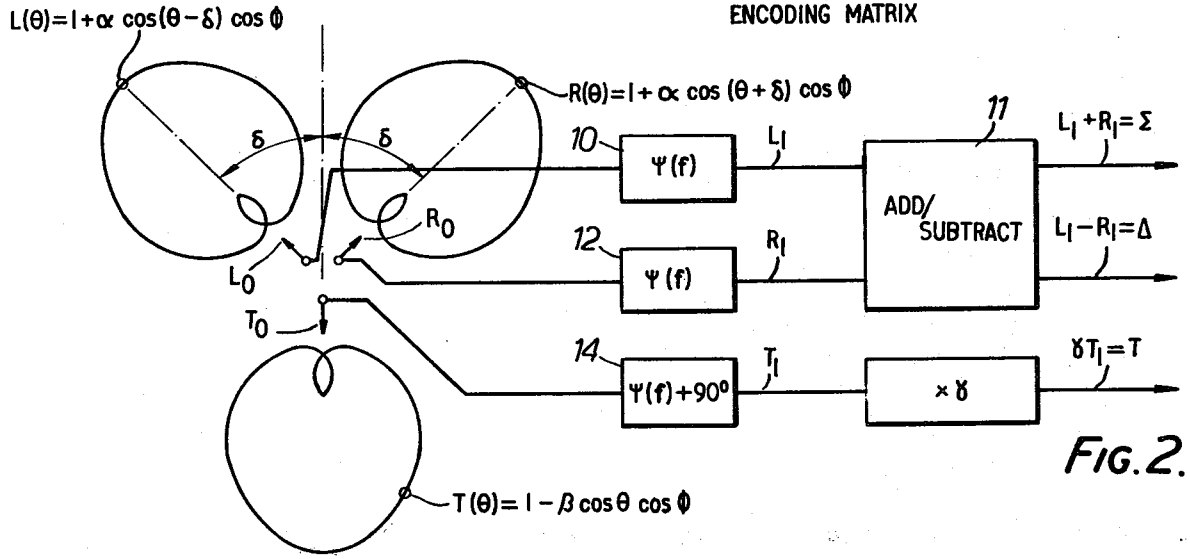
FIG. 2 is a diagrammatic representation of an alternative for part of the embodiment shown in FIG. 1.

An alternative way to produce an approximation to the encoding of the Σ, Δ and T signals is shown in FIG. 2. In this Figure, it is not necessary to firstly produce the W, X and Y signals. Three directional microphones $L_o$, $R_o$, and $T_o$ are represented by their polar diagrams and once again, as in FIG. 1, azimuth is represented by θ and elevation by φ. The three mcirophones are placed as closely together as possible.

The microphone $L_o$ has a directional sensitivity proportional to $1+\alpha \cos(\theta-\delta) \cos \phi$ where α is a constant and its output is fed through an all pass filter network 10 to one input of an add/subtract circuit 11. The microphone $R_o$ has a directional sensitivity proportional to $1+\alpha \cos(\theta+\delta) \cos \phi$ and its output is fed through another all pass filter network 12 identical to network 10 to another terminal of the circuit 11 whose outputs $L_1+R_1$ and $L_1-R_1$ represent the Σ and Δ signals respectively. The microphone $T_o$ has a directional sensitivity proportional to $1-\beta \cos \theta \cos \phi$ and its output is fed through all pass filter network 14 which relative to networks 10 and 12 adds a 90° phase advance and thence to a multiplication network of coefficient γ to produce the T signal. Thereafter, the Σ, Δ and T signals are multiplexed and transmitted as before. The preferred values of α, β, γ and δ are as follows: $\alpha=1.097$; $\beta=1.414$; $\gamma=-0.879$, $\delta=81°$ where δ is the ½ angle between $L_o$ and $R_o$ microphones.

Figure 3:
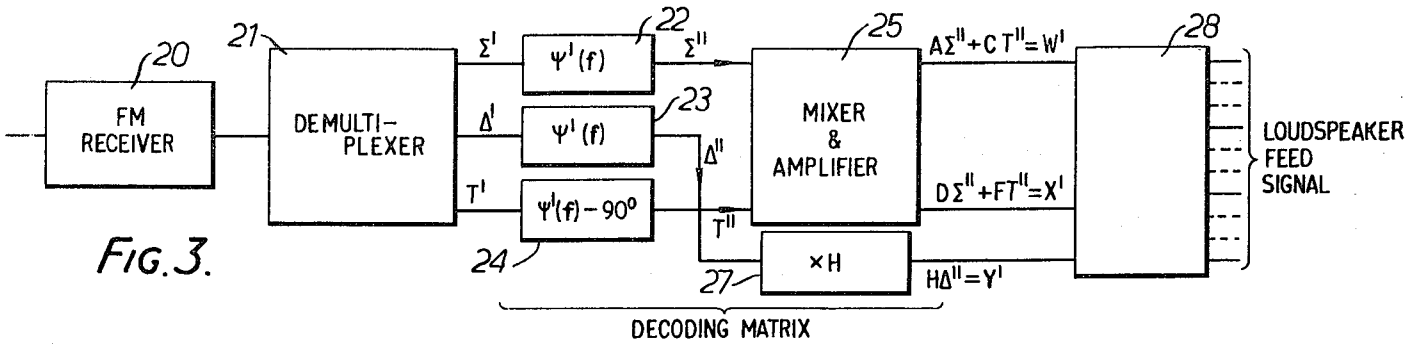
FIG. 3 is a block diagram representation of a receiver for receiving the signal transmitted by the transmitter of FIG. 1.

FIG. 3 shows a block diagram of a receiver which is used in conjunction with an Ambisonic decoder and hence the signal path is the opposite to that shown in FIG. 1.

The r.f. signal is received in an F.M. receiver 20 which feeds a demultiplexer 21 part of which will be described in more detail later with reference to FIG. 4. The output of the demultiplexer 21 is the three de-emphasised signals Σ', Δ' and T' which are fed to a decoding matrix, consisting of two identical all-pass filter networks 22, 23 for the Σ' and Δ' signals respectively, and an all-pass filter network 24 for the T' signal which generates a phase shift lagging by 90° relative to the phase shift of networks 22, 23. The outputs from the networks 22 and 24 are fed to a linear mixing and amplifying network 25 where signals $A\Sigma''+CT'=W'$ and $D\Sigma''+FT'=X'$ are produced. The output from the network 23 is fed through a multiplication network 27 of co-efficient H to form the Y' signal. The W', X' and Y' signals are then fed to a conventional Ambisonic decoder 28 which produces the loudspeaker feed signals in known manner.

The coefficients A C D F H are related to the terms a b f g h in the encoding matrix by the equations $$A=h/(gb-ha),\ C=b(gb-ha),\ D=g(gb-ha),\ F=-a(gb-ha),\ H=1/f.$$

Figure 4:
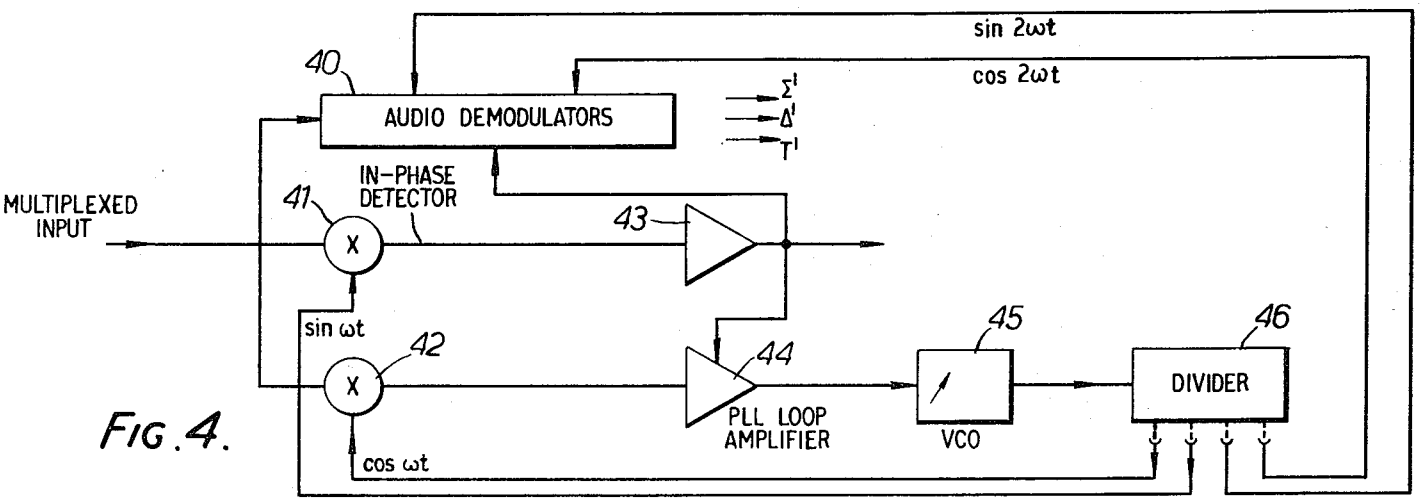
FIG. 4 shows a block diagram of a part of the receiver shown in FIG. 3.

Turning now to FIG. 4, this shows a dual-mode phase lock loop which forms part of the demultiplexing circuit 21. It is to be remembered that the input to the demultiplexer is a pilot-tone system multiplexed transmission signal. This signal is fed directly to audio demodulators 40, to an input of a multiplying circuit 41 and to an input of another multiplying circuit 42. The output from the circuit 41 is fed to a d.c. amplifier 43. The output of the circuit 42 is fed to a phase lock loop amplifier 44 whose output drives a voltage controlled oscillator 45 which is used to control a divider circuit 46 which has one output representative of sin ωt which is fed to another input of the circuit 41 and another output representative of cos ωt which is fed to another input of the circuit 42. In this case, ω is approximately equal to 2πx pilot tone frequency. The circuit 41 and amplifier 43 thus form an in-phase detector of the input signal while the circuit 42 and amplifier 44 form a quadrature detector.

Further outputs from the divider 46 representative of sin 2ωT and cos 2ωT are used in the demodulators 40.

Three channel reception ideally requires a higher standard of separation between the Δ and T signals (in-phase and quadrature signals) than is normally attained in conventional stereo receivers. In the circuit shown in FIG. 4, the pilot tone frequency phase is measured with a high degree of precision. This is achieved by connecting the output of the amplifier 43 to the phase lock loop amplifier 44 so as to switch the phase lock loop to "fast" if no pilot tone is detected by the in-phase detector. Thus, the phase lock loop initially has a wide bandwidth with low d.c. loop gain until the pilot tone is detected whereupon the phase lock loop is switched to a narrow bandwidth with a high d.c. loop gain for normal running.

The output of the amplifier 43 is also used to provide a mono/stereo indication as well as to provide a switching signal to the audio demodulators 40 to switch them to "mono" if no pilot-tone is detected.

Figure 5:
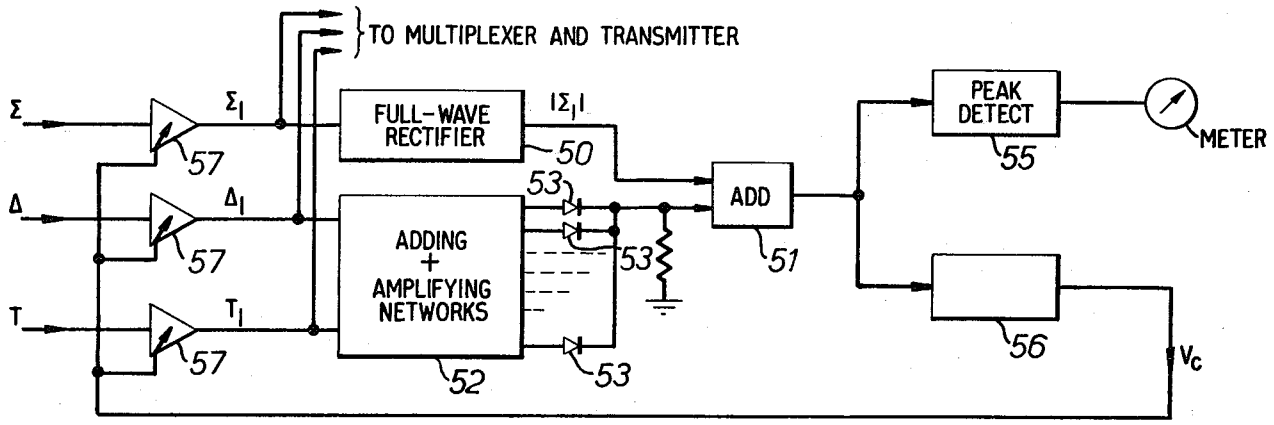
FIG. 5 shows a representation of a part of a transmitter for monitoring and controlling F.M. deviation.

FIG. 5 shows a circuit for monitoring and control of the FM deviation at the transmitter or in the studio or elsewhere. In stereo transmissions the deviation is simply related to the levels of the separate left and right channels; these levels are therefore used both for driving level meters (PPM's) used for manual control and within transmission limiters which automatically protect the transmitters from over-modulation. In three channel transmission there is no such simple relationship; the deviation is given by a complicated function of the three signals which includes, in particular, the expression $(\Delta^2+T^2)^{\frac{1}{2}}$. FIG. 5 is thus essentially an analogue computer for calculating the deviation from the three signals $\Sigma$, $\Delta$ and T, containing in particular an arrangement for generating a voltage proportional to the expression $(\Delta^2+T^2)^{\frac{1}{2}}$.

In FIG. 5 the $\Sigma_1$ signal is fed through a full wave rectifier 50 which provides a signal indicative of the modulus of $\Sigma_1$, which modulus signal is fed to one input of an adder circuit 51. The $\Delta_1$ and $T_1$ signals are fed to adding and amplifying networks indicated by reference numeral 52 which has a number of outputs for a range of discrete values of a parameter $\epsilon$ spaced uniformly from 0° to 360°. At each output there is present a voltage representative of the value of $\Delta_1 \cos \epsilon + T_1 \sin \epsilon$ for a particular value of $\epsilon$. These outputs are combined via diodes 53 and fed to one end of an earthed resistor whereby the most positive value of $\Delta_1 \cos \epsilon + T_1 \sin \epsilon_1$ is selected. This signal represents $(\Delta_1^2+T_1^2)^{\frac{1}{2}}$ and is fed to the adder circuit 51 to produce a signal $D=|\Sigma|+(\Delta_1^2+T_1^2)^{\frac{1}{2}}$. The practical circuit includes means, not shown here, for making allowance for the voltage offsets introduced by the diodes 53.

Alternatively, the circuit 52 may be provided will full wave rectification means in the $\Delta_1$ and $T_1$ signal paths whereby each output provides a signal of the form $|\Delta_1| \cos \epsilon + |T| \sin \epsilon$ in which case the range of values of $\epsilon$ is only from 0° to 90°. In either case, any desired degree of accuracy is obtained by spacing the values of $\epsilon$ sufficiently close together.

The signal D is shown as being used to drive a peak detecting circuit 55 which in turn drives a meter. Additionally, or as an alternative, the signal D is used for automatic limiting via a d.c. coupled threshold detector and loop amplifier circuit 56 whose output is a control voltage which is fed to a variable gain amplifier 57 in each of the input signal paths.

Other automatic limiting arrangements may be used in conjunction with the means described for obtaining the signal D e.g. a delay-line type, or a variable pre-emphasis type. The variable gain amplifiers 57 may alternatively operate on three signals derived by some linear combination of the signals $\Sigma_1$, $\Delta_1$, $T_1$, these latter signals being then regenerated by linear mixing to yield the same overall effect.

It is to be noted that the circuit of FIG. 5 may be used with other than the presently proposed three-channel system.

Programme material may sometimes be available not in the form of B-format but in a 4-channel format using signals known as LF, RF, LB and RB (representing left-front, right-front, left-back and right-back respectively). Commonly, in such a format sounds intended to be reproduced in the directions LF, RF etc. are represented by signals in the channels LF, RF etc. respectively alone, while sounds in intermediate directions are represented by signals only in the two channels between which the sound direction lies. Signals encoded in this format (known as "pairwise panning") cannot be exactly converted to B-format by a linear conversion matrix, but an approximate compromise is possible. It has previously been proposed that this approximate conversion to B-format be done by using a matrix of the form:

$$\begin{pmatrix} W \\ X \\ Y \end{pmatrix} = \frac{1}{2}\begin{pmatrix} K & K & K & K \\ 1 & 1 & -1 & -1 \\ 1 & -1 & 1 & -1 \end{pmatrix}\begin{pmatrix} LF \\ RF \\ LB \\ RB \end{pmatrix}$$

with K lying between 0.707 and 1.

In the present embodiment it is proposed that pairwise-panned material be converted approximately into B-format according to this previous proposal with K equal to or close to 0.888. After the resulting signals W X Y have been encoded into transmission signals $\Sigma$, $\Delta$, T by use of the encoding matrix with values a b f g h given above, the overall result is equivalent to use of the matrix:

$$\begin{pmatrix} \Sigma \\ \Delta \\ T \end{pmatrix} = \begin{pmatrix} 0.4540 & 0.4540 & 0.3448 & 0.3448 \\ 0.3448 & -0.3448 & 0.3448 & -0.3448 \\ 0.0222j & 0.0222j & -0.3732j & -0.3732j \end{pmatrix}\begin{pmatrix} LF \\ RF \\ LB \\ RB \end{pmatrix}$$

The received signals $\epsilon$, $\Delta$ and T are de-emphasised and then decoded in the same way as is described with reference to FIG. 3 to yield signals W', X', Y'; these signals are then fed into the B-format input of an Ambisonic decoder. The overall result of this is that at low frequencies the loudspeakers in a square layout are driven according to the matrix $$\begin{pmatrix} LF \\ RF \\ LB \\ RB \end{pmatrix} = \begin{pmatrix} 0.9909 & 0.7250 & -0.9909j \\ 0.9909 & -0.7250 & -0.9909j \\ 0 & 0.7250 & 1.2646j \\ 0 & -0.7250 & 1.2646j \end{pmatrix}\begin{pmatrix} \Sigma \\ \Delta \\ T \end{pmatrix}$$

but that at frequencies above about 400 Hz the shelf filters in the Ambisonic decoder change the matrix to:

$$\begin{pmatrix} LF \\ RF \\ LB \\ RB \end{pmatrix} = \begin{pmatrix} 1.0359 & 0.6279 & -0.8090j \\ 1.0359 & -0.6279 & -0.8090j \\ 0.1777 & 0.6279 & 1.1442j \\ 0.1777 & -0.6279 & 1.1442j \end{pmatrix}\begin{pmatrix} \Sigma \\ \Delta \\ T \end{pmatrix}.$$

A simple reduced-performance decoder could use an intermediate, frequency-independent matrix and the same decoder would be used for transmissions derived according to either this four channel source format or the three channel source format as proposed with reference to FIG. 1.

I claim:

1. In a system for transmission and reception of horizontal surround-sound by modulation of a carrier, wherein the modulating signal contains a monophonic audio signal Σ, a subcarrier modulated by an audio signal equivalent to the stereo difference signal Δ of a stereophonic broadcast, a pilot tone at half the subcarrier frequency, and a second subcarrier in quadrature with the first and modulated by a third audio signal T, the signals Σ, Δ and T being defined in terms of the direction of a sound to be reproduced, the improvement which comprises (a) means for generating the signal Σ;

(b) means for generating the signal Δ at a phase angle with respect to the signal Σ which is selected from an in phase relationship and a 180° out of phase relationship for all angular values of elevation and azimuth; and (c) means for generating the signal T with a phase shift of 90° with respect to the signals Σ and Δ.

2. Apparatus as defined in claim 1, wherein said means for generating the signals Σ, Δ, and T includes a matrix of the form:

$$\begin{pmatrix} \Sigma \\ \Delta \\ T \end{pmatrix} = \begin{pmatrix} a & b & 0 \\ 0 & 0 & f \\ gj & hj & 0 \end{pmatrix} = \begin{pmatrix} W \\ X \\ Y \end{pmatrix}$$

where a, b, f, g, h, are real and multiplication by j signifies a broadband phase advance of 90°, and where W, X and Y comprise source signals having amplitude ratios $1:\sqrt{2}\cos\theta\cos\phi:\sqrt{2}\sin\theta\cos\phi$, $\theta$ being the azimuth and $\phi$ the angle of elevation.

3. Apparatus as defined in claim 2, wherein said matrix has the specific value:

$$\begin{pmatrix} \Sigma \\ \Delta \\ T \end{pmatrix} \begin{pmatrix} 0.9 & 0.1092 & 0 \\ 0 & 0 & 0.6897 \\ -0.3954j & 0.3954j & 0 \end{pmatrix} \begin{pmatrix} W \\ X \\ Y \end{pmatrix}$$

4. Apparatus as defined in claim 1, wherein said generating means comprises three substantially coincident microphones connected with signal processing networks to provide said Σ, Δ and T signals.

5. Apparatus as defined in claim 1, and further comprising (d) means for receiving the frequency-modulated signal and for demultiplexing the three audio channels;

(e) phase-locked loop means locked to the pilot-tone for recovering the sub-carrier;

(f) means for monitoring detection of a signal by said phase-locked loop means; and (g) means for setting the bandwidth of said phase-locked loop means to be wide when no signal is detected by said monitoring means, whereby said phase-locked loop means acquires lock of the pilot-tone, and for setting the bandwidth to be narrow when a signal is detected by said monitoring means with said phase-locked loop means having high d.c. loop gain.

6. Apparatus as defined in claim 1, and further comprising (d) means for analog computation of the envelope of the multiplexed signal, exclusive of the pilot tone, starting from the three audio signals and using the formula $$D = |\Sigma| + (\Delta^2 + T^2)^{\frac{1}{2}}, \text{ and}$$

(e) means for selecting the most positive of a set of signals of the form $$|\Delta| \cos\epsilon + |T| \sin\epsilon,$$

where $\epsilon$ has a range of values from 0° to 360°.

7. Apparatus as defined in claim 1, and further comprising (d) means for analog computation of the envelope amplitude of the multiplexed signal, exclusive of the pilot-tone, starting from the three audio signals using the formula $$D = |\Sigma| + (\Delta^2 + T^2)^{\frac{1}{2}}; \text{ and}$$

(e) means for selecting the most positive of a set of signals of the form $$|\Delta| \cos\epsilon + |T| \sin\epsilon$$

where $\epsilon$ has a range of values from 0° to 90°.

8. Apparatus as defined in claim 6, and further comprising a peak reading meter arrangement connected to the output of said selection means for indicating F.M. deviation.

9. Apparatus as defined in claim 6, wherein said transmitter comprises means for automatically limiting F.M. deviation, said automatic limiting means comprising a peak detecting circuit connected to the output of said selecting means and variable gain elements for the three audio signals controlled in response to the output from said peak detecting circuit.

10. A system for producing a horizonal surround sound signal, comprising (a) means (1) for sensing sound in an area and for producing an omnidirectional sound signal (W), a depth sound signal (X), and a horizontal sound signal (Y), said depth and horizontal sound signals being a function of said omnidirectional sound signal;

(b) means for encoding and modulating said omnidirectional, depth, and horizontal sound signals to produce a monophonic audio signal (Σ), a first subcarrier modulated by an audio signal equivalent to a stereo difference audio signal (Δ) of a stereophonic broad broadcast, a pilot tone at half the subcarrier frequency, and a second subcarrier in quadrature with said first subcarrier and modulated by a third audio signal (T), the signals Σ, Δ, and T being defined in terms of the direction of the sound being reproduced, said encoding means comprising (1) mixer and amplifier means (2) for processing said omnidirectional and depth sound signals;

(2) multiplier means (5) for processing said horizontal sound signal;

(3) first filter means (3) connected with one output of said mixer and amplifier means to produce said monophonic audio signal Σ, (4) second filter means (6) similar to said first filter means and connected with the output of said multiplier means to produce said difference signal Δ at a phase angle with respect to said signal Σ which is selected from an in phase relationship for all angular values of elevation and azimuth; and (5) third filter means (4) connected with another output of said mixer and amplifier means to produce said third audio signal T with a phase shift of 90° with respect to said signals Σ and Δ;

(c) multiplexer means (7) for multiplexing said signals ϵ, Δ, and T, whereby a high quality stereo signal is produced for transmission.

* * * * *